US006065308A

United States Patent [19]

Piat et al.

[11] Patent Number: 6,065,308

[45] Date of Patent: May 23, 2000

[54] FLEXIBLE METAL BAND

[75] Inventors: Daniel H. Piat, 36 avenue Thierry, 92410 Ville d'Avray; Emmanuel A. Piat, Paris, both of France

[73] Assignees: Daniel H. Piat; Cristofol Freres, both of Paris, France

[21] Appl. No.: 09/194,769

[22] PCT Filed: Jun. 2, 1997

[86] PCT No.: PCT/FR97/00954

§ 371 Date: Dec. 2, 1998

§ 102(e) Date: Dec. 2, 1998

[87] PCT Pub. No.: WO97/46131

PCT Pub. Date: Dec. 11, 1997

[30] Foreign Application Priority Data

Jun. 3, 1996 [FR] France ..... 96 06793

[51] Int. Cl.[7] ..... A44C 25/00

[52] U.S. Cl. ..... 63/37; 63/3; 63/4; 63/26; 63/28

[58] Field of Search ..... 63/3, 4, 26, 27, 63/28, 31, 37

[56] References Cited

U.S. PATENT DOCUMENTS

| | | | |
|---|---|---|---|
| 775,030 | 11/1904 | Fairbrother, Jr. | 63/28 |
| 813,084 | 2/1906 | Dover | 63/26 |
| 1,245,965 | 11/1917 | Pratt | 63/38 |
| 1,476,462 | 12/1923 | Pejchar | 63/26 |
| 1,518,745 | 12/1924 | Mehrlust | 63/4 X |
| 2,139,512 | 12/1938 | Nagorny | 63/37 |
| 2,141,363 | 12/1938 | Rigollet | 63/26 X |
| 2,584,207 | 2/1952 | Holl | 63/27 |
| 4,914,930 | 4/1990 | Bielka | 63/28 |
| 5,592,835 | 1/1997 | Herr | 63/4 |

*Primary Examiner*—Terry Lee Melius
*Assistant Examiner*—Andrea Chop
*Attorney, Agent, or Firm*—Ostrolenk, Faber, Gerb & Soffen, LLP

[57] ABSTRACT

A flexible metal strip for making bracelets made up of a plurality of identical elements of hexagonal section arranged side by side and interconnected by link devices. Each element comprises a bottom piece and a top piece superposed thereon. The top piece is annular and surrounds a sleeve which extends axially from the top face of the bottom piece and which is used for crimping the top piece on the bottom piece. Each link device is constituted by a triangularly-shaped ring which links together three adjacent elements. The link element is received in radial grooves formed in the top faces of the bottom pieces of said three adjacent elements.

13 Claims, 3 Drawing Sheets

FIG.2
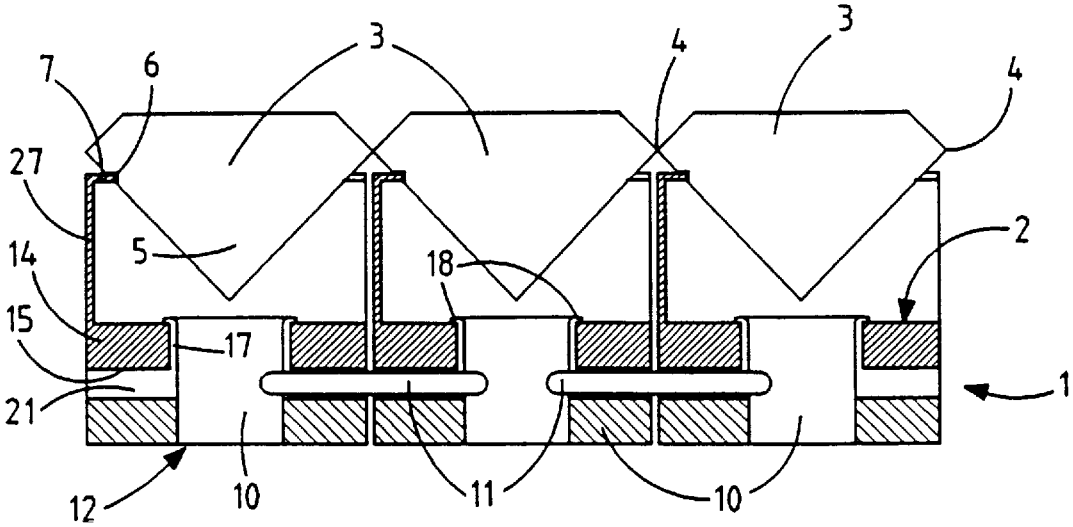
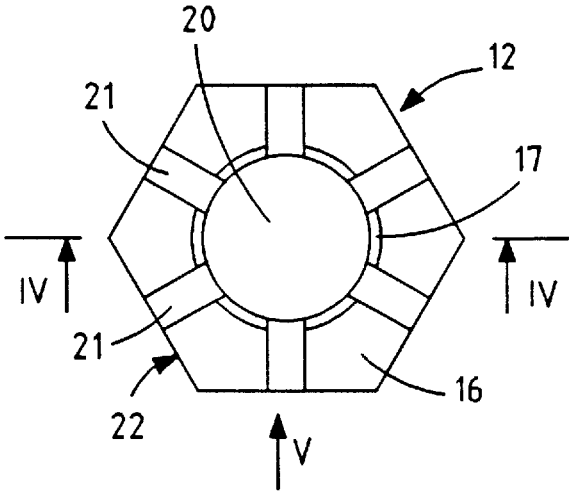
FIG.3
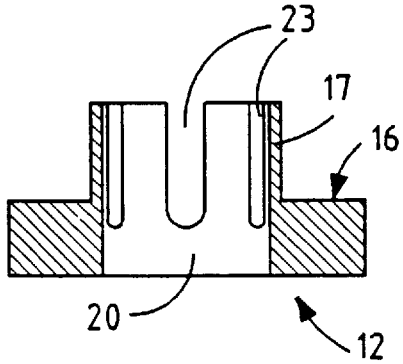
FIG.4
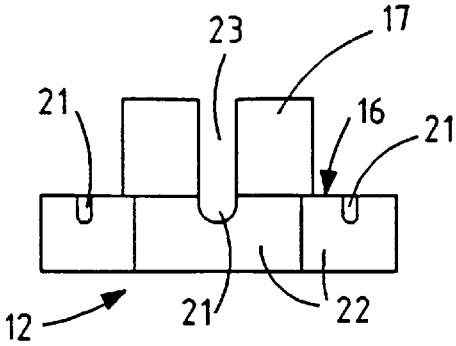
FIG.5

FLEXIBLE METAL BAND

BACKGROUND OF THE INVENTION

The present invention relates to flexible metal strips used in jewelry for making bracelets or necklaces, e.g. bracelets or necklaces with visible faces having a plurality of hexagonal section gemstones arranged side by side and set in bezels by invisible settings.

More precisely, the invention relates to a flexible metal strip made up of a plurality of identical elements of hexagonal section arranged side by side and interconnected by link devices.

SUMMARY OF THE INVENTION

Each element may have in its top face a bezel in which a gemstone is set, however the invention is not limited to a metal strip of this type.

According to the invention, the strip includes a bottom piece, and by a top piece disposed on the bottom piece and connected thereto by crimping, the top piece being annular and surrounding a sleeve which extends axially from the top face of the bottom piece and which serves to crimp the top piece on the bottom piece, each link device is comprised of a triangulary-shaped ring which interconnects three adjacent elements, said ring being received in grooves formed in the top faces of the bottom pieces of said three elements.

Advantageously, the bottom piece is annular and has a through hole on the axis of the sleeve; the grooves extend radially from said through hole and the sleeve has axial slots in register with said grooves. The bottom piece has six grooves respectively perpendicular to the six side faces of said bottom piece.

On its top face, the top piece may have fixing means for fixing a gemstone. Advantageously, said fixing means are constituted by claws formed at the ends of three tabs which extend axially from three non-adjacent sides of said top piece.

BRIEF DESCRIPTION OF THE DRAWINGS

Other advantages and characteristics of the invention appear on reading the following description given by way of non-limiting example and made with reference to the accompanying drawings, in which:

FIG. 2 is a section view on line II—II of FIG. 1;

FIG. 3 is a plan view of a strip element;

FIG. 4 is a section view of the bottom piece, the section being on line IV—IV of FIG. 3;

FIG. 5 is a side view of the bottom piece of FIG. 3, this view being seen in the direction of arrow V in FIG. 3;

DETAILED DESCRIPTION OF THE PREFERRED EMBODIMENTS

Figure 1:
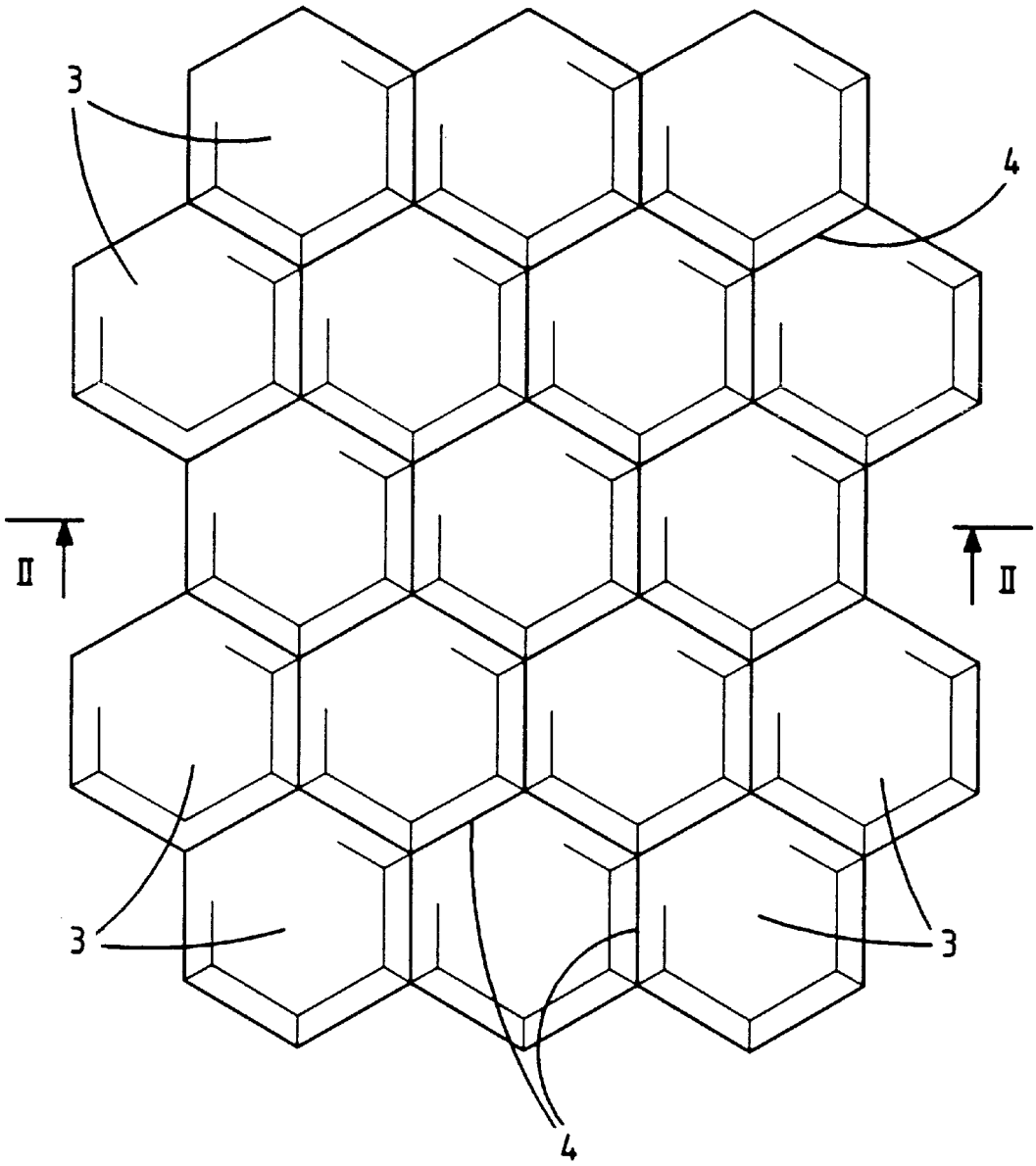
FIG. 1 is a plan view of a portion of bracelet made using the flexible metal strip of the invention and carrying on its top face a plurality of hexagonal section gemstones arranged side by side.

The drawings show a flexible metal strip 1 fitted on its top face 2 with a plurality of gemstones 3 of hexagonal section that are arranged side by side and whose edges 4 touch in pairs. A pavilion 5 of each gemstone 3 has horizontal grooves 6 into which there penetrate claws 7 secured to the metal strip 1.

The flexible metal strip 1 is made up of a plurality of strip elements 10 of hexagonal section that are interconnected by fixing devices 11.

Each strip element 10 is of hexagonal section that is slightly smaller than the hexagonal section of a gemstone 3, and it is placed beneath a gemstone 3, thus imparting flexibility to the strip 1.

Figure 6:
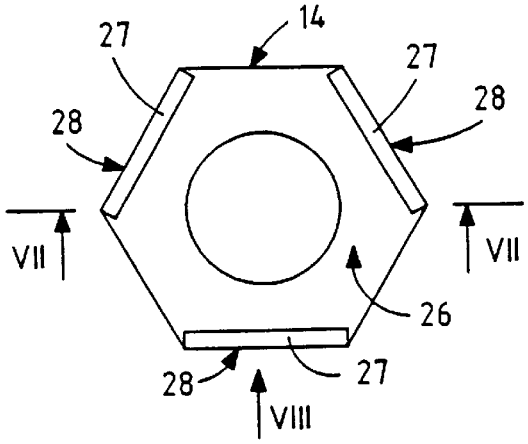
FIG. 6 is a plan view of the top piece of a strip element.
Figure 7:
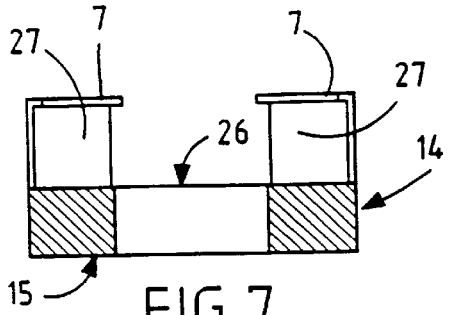
FIG. 7 is a section view of the FIG. 6 top piece, the section being on line VII—VII of FIG. 6.
Figure 8:
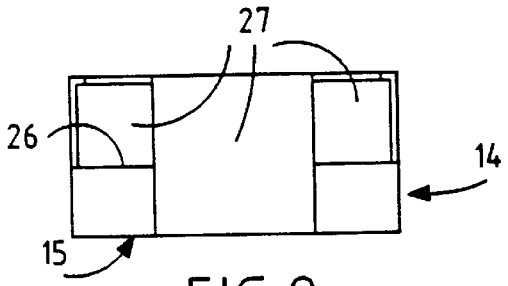
FIG. 8 is a side view of the FIG. 6 top piece, this view being seen in the direction of arrow VIII of FIG. 6.

Each strip element 10 has a bottom piece 12 shown in FIGS. 3 to 5 and a top piece 14 shown in FIGS. 6 to 8, both of which pieces are hexagonal in section. The top piece 14 is disposed above the bottom piece 12, its bottom face 15 being in contact with the top face 16 of the bottom piece 12. The top piece 14 is annular and it surrounds a sleeve 17 extending longitudinally from the top face 16 of the bottom piece 12. The height of the sleeve 17 is greater than the thickness of the top piece 14 so that the top piece 14 can be fixed to the bottom piece 12 by crimping in which the end 18 of the sleeve 17 is plastically deformed outwards, as can be seen in FIG. 2.

As shown in FIGS. 3 to 5, the bottom piece 12 is also annular and it has a through hole 20 extending the internal cavity of the sleeve 17. Six axial grooves 21 perpendicular to the six side faces 22 of the bottom piece 12 are formed in the top face 16 of the bottom piece 12. These grooves 21 extend between the through hole 20 and the side faces 22. The sleeve 17 has six slots 23 in register with the grooves 21.

The fixing devices 11 include by closed rings of generally triangular shape with rounded vertices 25, which rings are received in the grooves 21 of three adjacent bottom pieces 12. The length of each side of a ring 11 is determined so that the rounded vertices 25 are received in the through holes 20 of adjacent bottom pieces 12.

Figure 9:
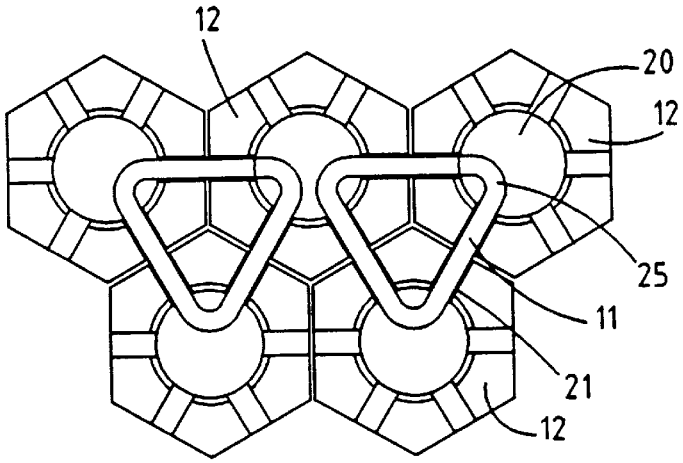
FIG. 9 shows how link devices are mounted on bottom pieces arranged side by side.

The strip 1 is assembled as follows: bottom pieces 12 are arranged side by side on a work surface, as shown in FIG. 9; the rings 11 are then placed in the grooves 21 causing them to pass through the slots 23 in the sleeves 17; thereafter, the top pieces 14 are placed on the bottom pieces 12, and the ends 18 of the sleeves 17 are deformed by crimping.

Advantageously, the top piece 14 has on its top face 26 three tabs 27 which extend axially from three nonadjacent edges 28 and which include at their top ends the claws 7 that are to penetrate into the grooves 6 formed in the pavilion 5 of a gemstone 3.

Figure 10:
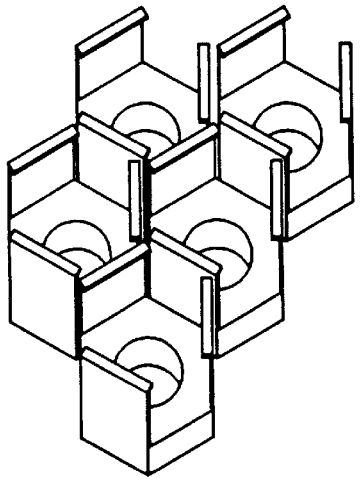
FIG. 10 is a perspective view of the top face of a strip with its bezels.

As can be seen in FIG. 10, on assembly, the top pieces 14 are disposed on the bottom pieces 12 in such a manner that any tab 27 of a given top piece 14 lies between the tabs of adjacent top pieces.

The metal strip 1 is thus made up of three different kinds of piece. All of the bottom pieces 12 are identical. The same is true of the top pieces 14 and of the linking rings 11. The top pieces 14 and the bottom pieces 12 are made in conventional manner using numerically controlled machine tools that enable the desired degree of machining accuracy to be obtained.

We claim:

1. A flexible metal strip comprising:

a plurality of identical elements having a hexagonal cross-section arranged side by side and interconnected by link devices each element including a bottom piece, and a top piece disposed on the bottom piece and connected thereto by crimping, the top piece being annular and surrounding a sleeve which extends longitudinally from a top face of the bottom piece and which serves to crimp the top piece on the bottom piece, and each link device includes a triangularly-shaped ring which interconnects three adjacent elements, the ring being received in grooves formed in the top faces of the bottom pieces of the three adjacent elements.

2. A strip according to claim 1, wherein:

the bottom piece is annular and has a through hole on the axis of the sleeve, the grooves extend radially from said through hole and the sleeve has axial slots in register with said grooves.

3. A strip according to claim 2, wherein:

the bottom piece has six grooves and six side faces, the six grooves respectively being perpendicular to the six side faces of the bottom piece.

4. A strip according to claim 3, wherein the top piece has a top face, the top face of the top piece including fixing means for fixing a gemstone.

5. A strip according to claim 4, wherein the fixing means comprises claws formed at ends of three tabs, the three tabs extending axially from three non-adjacent sides of the top piece.

6. A strip according to claim 1, wherein:

the top piece has a top face, the top face of the top piece including fixing means for fixing a gemstone.

7. A strip according to claim 6, wherein the fixing means comprises claws formed at ends of three tabs, the three tabs extending axially from three non-adjacent sides of the top piece.

8. A strip according to claim 2, wherein the top piece has a top face, the top face of the top piece including fixing means for fixing a gemstone.

9. A strip according to claim 8, wherein the fixing means comprises claws formed at ends of three tabs, the three tabs extending axially from three non-adjacent sides of the top piece.

10. A flexible strip comprising:

a plurality of strip elements, each of said strip elements having a top piece and a bottom piece, each of said bottom pieces having a top face and a groove in said top face;

a plurality of sleeves, each said sleeve connected to and extending from a respective one of said bottom pieces, each said sleeve covering a respective said top piece thereby coupling said top and bottom pieces together;

at least one link device which couples said strip elements together, said link device being disposed in said grooves in said top faces of said bottom pieces;

each of said top pieces has a receiver for receiving a gemstone; each of said top pieces has six sides; and each of said receivers is in the form of three tabs extending inwardly on non-adjacent sides of said respective top piece.

11. The flexible strip as claimed in claim 10, wherein:

said link device is in the form of a ring, said ring being received in said grooves; and each said sleeve includes axial slots in alignment with said grooves.

12. The flexible strip as claimed in claim 11, wherein said ring is triangular in shape.

13. The flexible strip as claimed in claim 10, wherein said top pieces, said bottom pieces, and said sleeves are all annular in shape.

* * * * *